US005235297A

United States Patent [19]

Tawil

[11] Patent Number: 5,235,297

[45] Date of Patent: Aug. 10, 1993

[54] DIRECTIONAL COUPLING MANIFOLD MULTIPLEXER APPARATUS AND METHOD

[76] Inventor: Saleem Tawil, 4806 Balcones Dr., Austin, Tex. 78731

[21] Appl. No.: 844,510

[22] Filed: Mar. 2, 1992

[51] Int. Cl.[5] ..... H01P 1/213; H01P 5/16

[52] U.S. Cl. ..... 333/110; 333/114; 333/135; 333/21 A

[58] Field of Search ..... 333/21 A, 110, 126, 333/135, 114, 122

[56] References Cited

U.S. PATENT DOCUMENTS

| | | | |
|---|---|---|---|
| 2,607,849 | 8/1952 | Purcell . | |
| 2,999,988 | 9/1961 | Marie | 333/110 X |
| 3,668,564 | 6/1972 | Ren et al. | 333/135 |
| 4,614,920 | 9/1986 | Tong | 333/135 |

OTHER PUBLICATIONS

A. E. Atia, Computer-Aided Design of Waveguide Multiplexers, IEEE Transactions on Microwave Theory, Mar. 1974, pp. 332-336.

Ming Hui Chen, A12-Channel Contiguous Band Multiplexer at Ku-Band, IEEE MTT-S Digest, 1983, pp. 77-78.

M. H. Chen, et al., A Contiguous Band Multiplexer, COMSAT Tech Review, vol. 6, No. 2, Fall 1976, pp. 285-307.

S. C. Holme, A 12 GHz Channel Contiguous Multiplexer for Satellite Applications, IEEE MTT-S Digest, 1984, pp. 295-298.

J. David Rhodes, Design of General Manifold Multiplexers, IEEE Transactions on Microwave Theory, vol. MTT-27, No. 2, Feb. 1979, 111-123.

J. David Rhodes, A Generalized Multiplexer Theory, IEEE Trans on Microwave Theory, vol. MTT-27, No. 2, Feb. 1979, pp. 99-111.

Franklin S. Coale, Applications of Directional Filters for Multiplexing Systems, IRE Trans on MW Theory, Oct. 1958, pp. 450-453.

W. D. Lewis, et al., A Non-Reflecting Branching Filter for Microwaves, Bell System Technical Journal, pp. 82-94.

Seymour B. Cohn, Impedance Measurement by Means of a Broadband Circular-Polarization Coupler, Proceedings of the IRE, pp. 1554-1558.

Matthaei, et al., Microwave Filters Impedance Matching Networks & Coupling Structures, 1980, pp. 847-865.

*Primary Examiner*—Paul Gensler

*Attorney, Agent, or Firm*—Shaffer & Culbertson

[57] ABSTRACT

A radio frequency multiplexer provides a desired channelization plan by directionally coupling high quality linearly polarized filters to a waveguide manifold. The multiplexer includes a waveguide manifold for transmitting signals in a plurality of different frequency channels, a polarization translating coupling aperture arrangement, a circular polarizer, and filter for each channel. Wide band signals traveling along the waveguide manifold exit the waveguide through the coupling aperture arrangement. The linearly polarized signal from the waveguide manifold translates to a circularly polarized signal through the coupling aperture arrangement and these circularly polarized signals are translated back to linearly polarized signals by the circular polarizer. The linearly polarized wide band signals from the circular polarizer are then filtered with the filter device which allows only signals in a channel to be separated to pass. Signals in the channel to be separated then exit the filter through a single channel transmission line. The multiplexer apparatus also allows multiple channels to be combined in the waveguide manifold. Signals from each channel are combined without interaction of amplitude and phase of each signal. Also, any linearly polarized filter can be employed to provide the desired filter response for each channel.

14 Claims, 4 Drawing Sheets

DIRECTIONAL COUPLING MANIFOLD MULTIPLEXER APPARATUS AND METHOD

BACKGROUND OF THE INVENTION

This invention relates to multiplexing UHF or microwave channels, and more particularly to an apparatus and method for multiplexing such channels using high quality filters directionally coupled to a manifold.

Multiplexing UHF or microwave channels is the process of combining signals of different frequencies. Demultiplexing UHF or microwave channels is the process of separating certain frequencies from a broad band signal. According to common practice, the term "multiplexing" will be used herein to describe both the process of combining and separating signals. Similarly, the term "multiplexer" as used herein shall refer to a device for combining signals, separating signals, or both.

The process of separating or combining signals is particularly desirable in UHF or microwave transmission. In UHF or microwave transmission, it is often desirable for a single microwave antenna to be shared by several transmitters or receivers operating on different frequency channels. The term "channel" as used herein shall refer to any particular frequency or band of frequencies such as, for example, a band of frequencies defined by the modulation or demodulation characteristics of a transmitting or receiving device. In moderate to high power applications, channel multiplexing has been performed by either directional filter multiplexers or multiplexers that utilize a waveguide T-junction manifold having direct connecting lines.

Directional filters are four port devices that comprise a rectangular input waveguide, one or more cylindrical resonator cavities, a rectangular output waveguide, and coupling apertures in both the input and output waveguides that couple the waveguides to either end of the resonator cavities. To form a multiplexer, several directional filters are connected together sharing a common input or output waveguide. The common waveguide forms a wide band waveguide capable of carrying or transmitting several different channels. Each directional filter serves either to separate a particular channel from wide band signals traveling along the common waveguide or combine a particular channel with other channels traveling along the common waveguide.

The coupling to both the input and output waveguide of a directional filter is directional. As a result of the directional coupling to the output waveguide, a circularly polarized signal having a given direction of rotation through the resonator cavities will translate through the coupling aperture of the output waveguide to a linearly polarized signal traveling in one direction through the output waveguide. Similarly, a linearly polarized signal of the appropriate frequency traveling through the input waveguide will translate through the coupling aperture of the input waveguide to a circularly polarized signal rotating in a single direction of rotation as it travels through the resonator cavities. Therefore, the coupling to each waveguide in a directional filter multiplexer is theoretically 100% and is not sensitive to phase or magnitude changes of any channel frequency present.

Directional filter multiplexers rely on the off-resonant reactance characteristics of the resonator cavity or cavities for frequency filtering. That is, directional filter multiplexers utilize the resonator cavity or cavities as a circularly polarized signal filter. However, circularly polarized filters provide relatively poor filter performance. This low quality filter response or performance has prevented directional filter multiplexers from being used in applications that require high performance characteristics and/or very close channel spacing.

Waveguide T-junction manifold multiplexers include a rectangular wide band waveguide or waveguide manifold capable of transmitting signals in several different channels, and several channel filters each joined to the manifold through a T-junction. Each filter produces a desired frequency filter response, thereby allowing only signals in a particular frequency range to travel through the particular channel filter. Because waveguide T-junction manifold multiplexers can utilize many different filter designs, such multiplexers have superior channel performance characteristics and may be used with very close channel spacing.

While waveguide T-junction manifold multiplexers have superior filter characteristics, impedance control required in such multiplexers is difficult to achieve. The difficulty in impedance control arises because each single channel filter is loosely coupled to the waveguide manifold. That is, signals in each channel travel in the waveguide manifold in both directions from the junction. As a result of the loosely coupled channels, the multiplexer designer must account for phase and magnitude of all channel filters. The solution for a multiplexer design becomes quite complex when even three channels are involved. When the number of channels becomes large, the solution becomes nearly impossible.

SUMMARY OF THE INVENTION

It is a general object of the invention to provide a radio frequency multiplexer and multiplexing method that overcome the above described problems and others relating to radio frequency multiplexing.

The object of the invention is accomplished by directionally coupling high quality microwave frequency filters to a wide band waveguide or waveguide manifold. Directionally coupling each channel signal to the waveguide manifold results in constant impedance at all coupling points. Also, a multiplexer according to the invention may employ any filter design, particularly linearly polarized filters which operate on signals that are linearly polarized, and may provide a very high quality filter response.

For each channel, the waveguide manifold is coupled by a separate coupling aperture to a different circular polarizer or quarter wave plate. Each coupling aperture is critically positioned to translate the signal polarization as the signal passes through the aperture. That is, a circularly polarized signal incident on the aperture from the circular polarizer translates to a linearly polarized signal traveling in a single direction in the waveguide manifold. Also, because the coupling is reciprocal, a linearly polarized signal traveling along the waveguide manifold translates to a circularly polarized signal in the circular polarizer as the signal passes through the coupling aperture.

The circular polarizer translates a linearly polarized signal traveling in the direction toward the coupling aperture to a circularly polarized signal of a desired rotation. This circularly polarized signal is then directionally coupled to the waveguide manifold by the coupling aperture. Also, the circular polarizer is a reciprocal device and thus translates a circularly polarized signal traveling from the coupling aperture to a linearly polarized signal as the signal passes therethrough.

The multiplexer apparatus according to the invention is completed with a different linearly polarized filter connected or coupled to the end of each circular polarizer opposite the end connected to the waveguide manifold. Each filter provides a desired filter response to signals traveling from the waveguide manifold through the respective coupling aperture and circular polarizer. Therefore, signals outside the desired frequency band do not pass through the particular channel filter but return to the waveguide manifold and continue traveling in the direction in which they were originally travelling. Each filter is chosen to create a channel having a desired shape to a range or band of frequencies.

A multiplexer embodying the principles of the invention has several advantages over prior radio frequency multiplexers. First, the multiplexer provides constant impedance at each coupling point to the waveguide manifold since each channel is directionally coupled to the waveguide manifold. A multiplexer having a desired channelization plan can be created simply by connecting several waveguide manifold sections together, each waveguide manifold section including a coupling aperture, circular polarizer, and filter for a single channel. Channels can be added or subtracted from such a multiplexer without having to redesign the entire multiplexer to account for signal magnitude and phase of each channel. Also, multiple channel multiplexer sections may be produced in which a unitary waveguide manifold section includes a plurality of coupling apertures, each aperture with its own circular polarizer and filter.

Beyond the flexibility provided by the directional coupling of each channel, any desired frequency filter response or filter device may be employed with each channel. That is, the multiplexer according to the invention does not depend upon the circularly polarized filter effect of the cavities required in directional filter multiplexers.

These and other objects, advantages, and features of the invention will be apparent from the following description of the preferred embodiments, considered along with the accompanying drawings.

DESCRIPTION OF THE PREFERRED EMBODIMENTS

Figure 1:
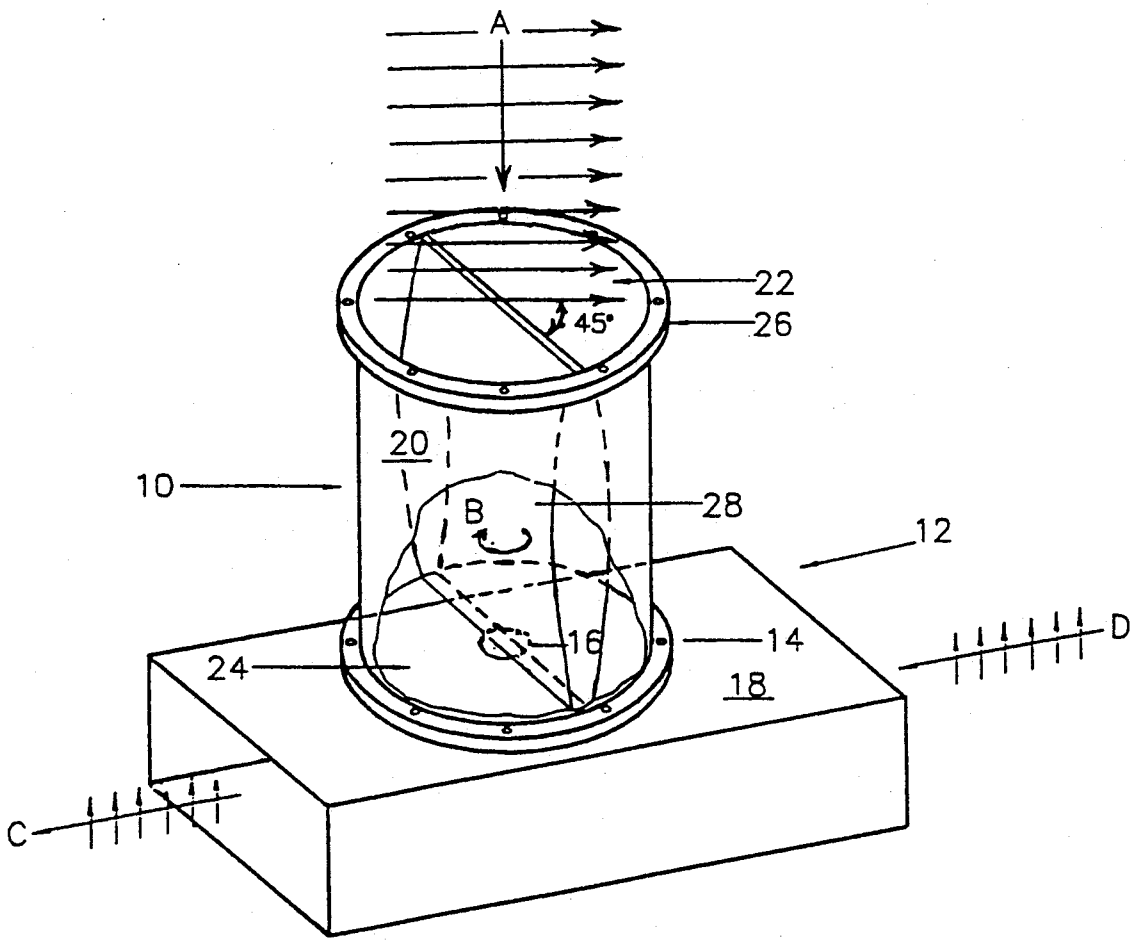
FIG. 1 is a somewhat schematic and partially cutaway view in perspective of a circular polarizer and waveguide coupling embodying the principles of the invention.

FIG. 1 shows a circular polarizer or circular polarizing waveguide 10 coupled to a waveguide manifold 12 according to the invention. The waveguide manifold 12 comprises a rectangular waveguide section having walls made of a suitable conducting material and capable of transmitting signals in a broad radio frequency band or range. As used herein, "signals" or "radio frequency signals" shall mean electromagnetic signals generally in the frequency range of 300 to 300,000 megahertz, including but not limited to UHF and microwave signals. The circular polarizer 10 is connected to the waveguide manifold 12 with a suitable connection 14 and is coupled to the waveguide manifold through a coaxially aligned coupling aperture 16.

The coupling aperture 16 effects or performs a polarization translation as a signal travels there through. That is, a circularly polarized signal B traveling through the circular polarizer 10 to the aperture 16 translates to a linearly polarized signal C traveling through the waveguide manifold 12 in a single direction. Also, since the coupling is reciprocal, a linearly polarized signal D traveling along the waveguide manifold 12 translates to a circularly polarized signal in the circular polarizer 10 as it passes through the coupling aperture 16. Thus, the coupling aperture 16 produces a directional coupling between the circular polarizer 10 and the waveguide manifold 12.

As indicated in FIG. 1, the circular polarizer 10 and coaxial coupling aperture 16 are offset from the centerline of the long wall 18 of the waveguide manifold 12. This offset is required in order to create the desired polarization translation. As is known in the art, the distance that the axes of the aperture 16 and the circular polarizer 10 are spaced from the side edge of the long wall 18 is generally related to the width of the long wall, the dimensions of the coupling aperture and circular polarizer, and the wavelength of the signal to pass through the aperture.

Those skilled in the art will readily appreciate that there are a variety of coupling means that can effect the desired polarization translation between the circular polarizer 10 and the waveguide manifold 12. For example, a single rectangular aperture may be used alternatively to the circular aperture shown in FIG. 1. Also, multiple slot-shaped aperture arrangements or any other polarization translating coupling may be employed.

The circular polarizer 10 comprises a cylindrical waveguide section 20 having a first polarizer port 22 and a second port 24. The second polarizer port 24 is shown in FIG. 1 connected to the waveguide manifold 12 by the connector 14, in this case a flange. The first polarizer port 22 also includes a connector 26 for connecting to a desired waveguide element but is shown unconnected in FIG. 1 for purposes of illustration. The illustrated circular polarizer 10 also includes a dielectric slab 28 critically positioned therein. As is known in the field, the dielectric slab 28 serves to translate linearly polarized signals A to circularly polarized signals B as the radio frequency energy travels along the waveguide 20 from the first polarizer port 22 to the second polarizer port 24. The dielectric slab 28 also serves to translate circularly polarized signals B traveling in the direction from the second port 24 to the first port 22 to linearly polarized signals.

As illustrated in FIG. 1, the linearly polarized signal A traveling into the circular polarizer 10 with the plane of polarization at a 45 degree angle to the dielectric slab 28 as shown translates to the clockwise rotating circularly polarized signal B within the circular polarizer. This circularly polarized signal B traveling toward the waveguide manifold 12 translates again through coupling aperture 16 to the linearly polarized signal C. Thus the invention directionally couples a linearly polarized signal to the waveguide manifold 12 using the aperture 16 and a circular polarizer 10 rather than two rectangular to circular waveguide apertures as in directional filters used in directional filter multiplexers.

Those skilled in the art will readily appreciate that there are a variety of circular polarizer designs capable of translating a linearly polarized signal to circularly polarized signal and vice versa. These circular polarizing devices are also known as quarter wave plates. Some circular polarizers employ a dielectric slab as shown in FIG. 1 while others utilize metal components or an iris arrangement. Any circular polarizer device may be employed in a multiplexer device embodying the principles of the invention to effect the desired polarization to or from the coupling aperture 16. Also, the circular polarizer may be rotated with respect to the plane of polarization of the linearly polarized signal to produce a circularly polarized signal having the opposite direction of rotation. The opposite direction of rotation produces a linearly polarized signal traveling in the opposite direction in the manifold 12.

Figure 2:
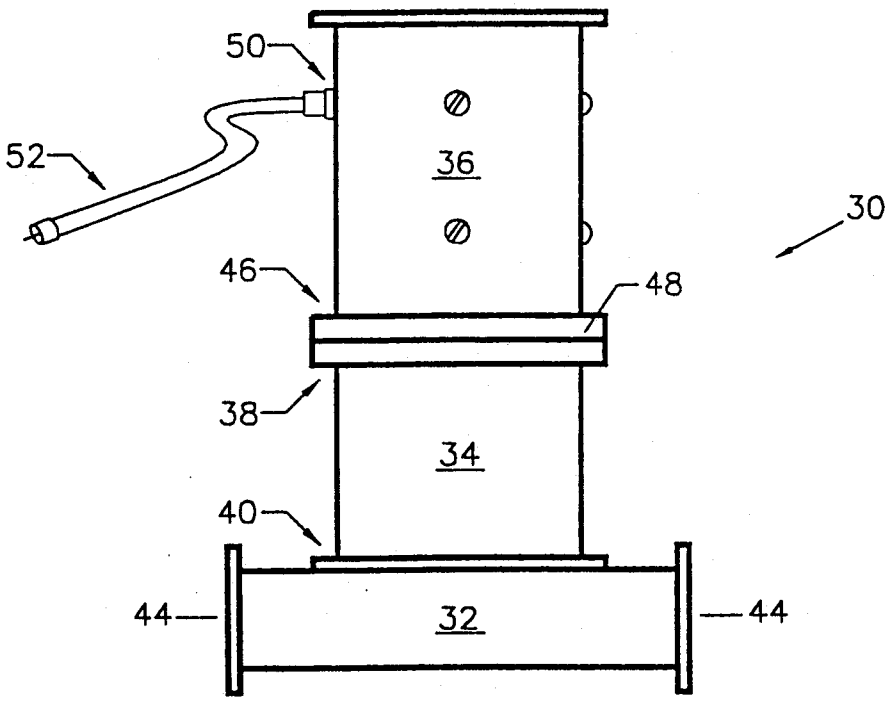
FIG. 2 is a somewhat schematic side view of a channel multiplexer embodying the principles of the invention.

The device shown in FIG. 1 provides virtually no filter response and therefore is not suitable for use where wide band signals are traveling along the waveguide manifold 12. FIG. 2 shows a single channel multiplexer section 30 embodying the principles of the invention that provides a desired filter response. The device 30 may also be referred to as a diplexer since it combines or separates a single channel. The multiplexer 30 includes a waveguide manifold section 32, a circular polarizer 34 such as the one shown in FIG. 1, and a radio frequency filter device 36 connected to a first port at a first end 38 of the circular polarizer 34. The second end 40 of the circular polarizer 34 includes a port coupled to the waveguide manifold section 32 through a polarization translating coupling aperture (not shown in FIG. 2) such as the aperture 16 shown in FIG. 1.

The waveguide manifold section 32 in this form of the invention also includes connector means 44 at each end for connecting the waveguide manifold section to other signal transmission elements, such as other waveguide sections, for example. Any suitable device may be employed as the connectors 44 including flange-type connectors as illustrated. The waveguide manifold section 32 is capable of transmitting multiple channels or wide band signals.

The filter 36 preferably comprises a high quality linearly polarized filter that provides the desired unique filter response for one channel. Any suitable linearly polarized filter device may be employed in a multiplexer embodying the principles of the invention. The illustrated filter 36 includes a first filter port at a first end 46 thereof connected by a suitable connector 48 to the first end 38 of the polarizer, and a single channel port 50 connected to a suitable single channel signal transmission line 52. In this case the single channel port 50 is schematically shown as a coaxial transmission line connector and the line 52 comprises a coaxial radio frequency transmission line. The transmission line 52 may, however, be any suitable radio frequency transmission line or waveguide.

In operation, a radio frequency signal or channel to be combined with other signals or channels is transmitted to the single channel port 50 of the filter 36. The signal propagates as a linearly polarized signal through the filter 36 and then through the first end 46 of the filter and first end 38 of the polarizer to the circular polarizer 34. The circular polarizer 34 translates the linearly polarized signal entering first end 38 to a circularly polarized signal having a desired direction of rotation. This circularly polarized signal exits the circular polarizer 34 through the polarizer second end 40 and the aperture to the manifold 32. The coupling aperture in the long manifold wall translates the circularly polarized signal back to a linearly polarized signal traveling in one direction in the waveguide manifold section 32.

The signal from the circular polarizer 34 in FIG. 2 is combined with wide band signals at other frequencies traveling in the same direction through the waveguide manifold section 32. The filter 36 produces a desired filter response preventing signals at other frequencies from traveling out of the transmission line 52. Thus, several of the multiplexers 30 or diplexers shown in FIG. 2 may be flanged or otherwise connected together by the waveguide connectors 44 to produce a desired multiplexer for combining several channels.

The multiplexer 30 shown in FIG. 2 may also operate to separate a signal or channel from signals at other frequencies. In this signal or channel separating operation, a wide band signal input to the manifold 32 includes signals or a channel to be separated from the remainder of the signals or channels present. All signals in the wide band input including the signal or channel to be separated are linearly polarized in the waveguide manifold 32 and translate to circularly polarized signals as they pass through the aperture in the long wall of the waveguide manifold and into the end 40 of the circular polarizer 34. The circular polarizer 34 translates these circularly polarized signals back to linearly polarized signals that exit the circular polarizer through its first end 38 and enter the filter 36 through the filter first end 46. The filter 36 produces a desired filter response to the incident wide band signals and redirects all signals other than the signal or channel to be separated back through the circular polarizer 34. The linearly polarized signal or channel to be separated exits the filter 36 through the single channel filter port 50 and is available for any desired processing or use through the single channel transmission line 52. All of the redirected or filtered signals travel back through the circular polarizer 34 where they are translated to circularly polarized signals and then directionally coupled back into the waveguide manifold 32 traveling in their original direction.

Those skilled in the art will readily appreciate that several of the multiplexer sections 30 shown in FIG. 2 may be connected by the waveguide connectors 44 to produce a multiple channel multiplexer for separating several different radio frequency channels. The filter 36 of each multiplexer section 30 would be chosen to provide a unique frequency filtering response to the incident wide band signals. Also, although the waveguide manifold 32, circular polarizer 34, and filter 36 are shown connected directly together in FIG. 2, other waveguide elements may be connected between the manifold, circular polarizer, and filter.

Figure 3:
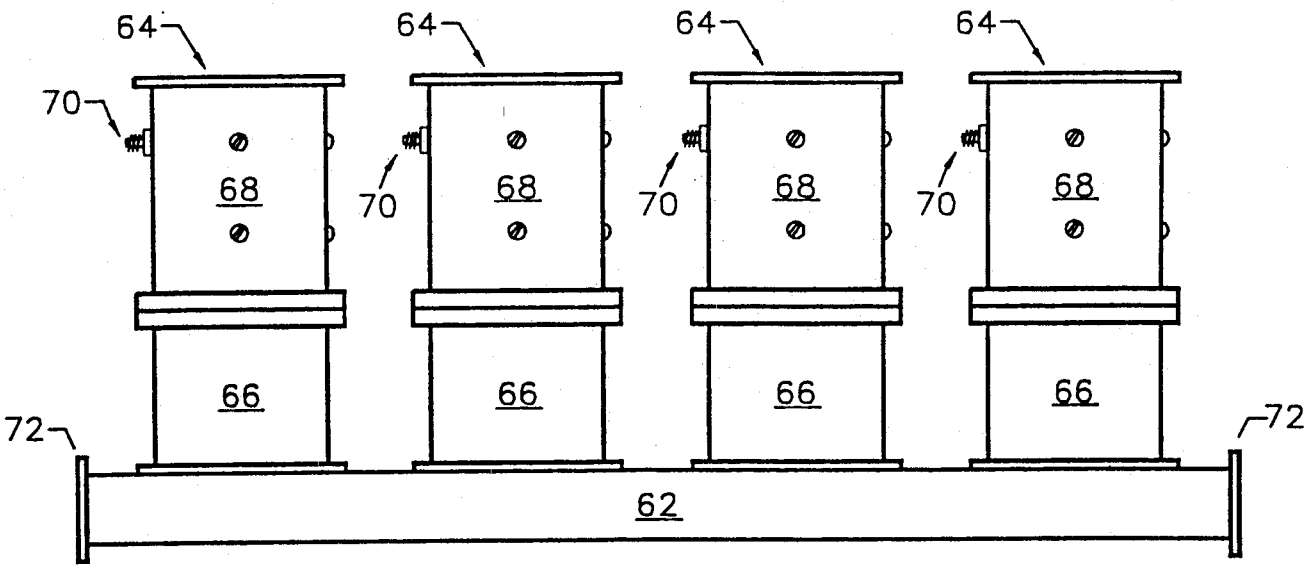
FIG. 3 is a somewhat schematic side view of a four channel unitary waveguide manifold multiplexer embodying the principles of the invention.
Figure 4:
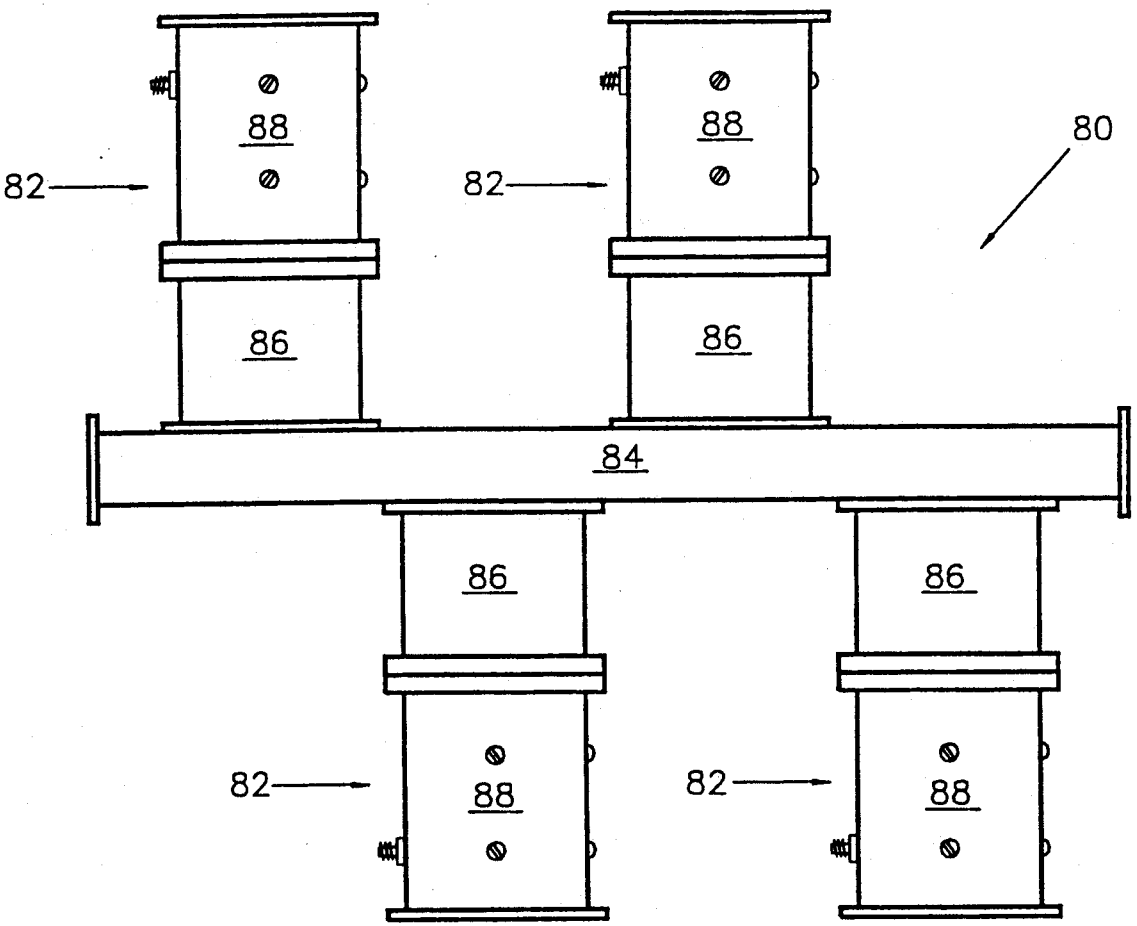
FIG. 4 is a somewhat schematic side view of an alternate multiple channel multiplexer embodying the principles of the invention.

FIGS. 3 and 4 show two alternative forms of multiple channel multiplexers embodying the principles of the invention. The multiplexer 60 shown in FIG. 3 includes a unitary waveguide manifold 62 with four separate channels 64. Each channel 64 includes a coupling aperture in the waveguide manifold 62 such as the one shown in FIG. 1, a circular polarizer 66 such as the one shown in FIGS. 1 and 2, and a channel filter 68 providing a desired unique filter response to the incident wide band signals. Single channel signals exit or enter the multiplexer 60 through a single channel port 70 associated with each channel filter 68. The operation of the multiplexer both to combine and separate signals is identical to a multiplexer formed from several single channel multiplexer sections 30 shown in FIG. 2. Also, the unitary waveguide manifold 62 shown in FIG. 3 includes connectors 72 at either end for connecting to other waveguide elements such as other single or multiple channel multiplexer sections.

FIG. 4 shows a four channel multiplexer 80 including channels 82 staggered along either broad side of a unitary waveguide manifold section 84. As with the embodiment shown in FIG. 3, each channel 82 includes a coupling aperture through the waveguide such as the aperture 16 shown in FIG. 1, a circular polarizer 86 and a channel filter 88. The channel configuration shown in FIG. 4 allows closer longitudinal spacing of the channels and therefore allows for shorter waveguide sections.

The above described preferred embodiments are intended to illustrate the principles of the invention, but not to limit the scope of the invention. Various other embodiments and modifications to these preferred embodiments may be made by those skilled in the art without departing from the scope of the following claims. For example, multiple channel unitary manifold multiplexers may be produced with more or fewer channels than shown in FIGS. 3 and 4. Also, many different varieties of circular polarizers and filters may be employed to produce multiplexers embodying the principles of the invention.

I claim:

1. A radio frequency signal transmission device comprising:

(a) a waveguide manifold for transmitting radio frequency signals;

(b) an elongated waveguide connected to receive linearly polarized radio frequency signals at a first port and having a second port connected to the waveguide manifold, the elongated waveguide being capable of transmitting both circularly polarized and linearly polarized radio frequency signals along substantially its entire length;

(c) circular polarizing means mounted within the elongated waveguide for translating linearly polarized radio frequency signals propagating in the direction from the first port toward the second port to circularly polarized signals and for translating circularly polarized radio frequency signals propagating in the direction from the second port toward the first port to linearly polarized signals; and (d) coupling means associated with the waveguide manifold for receiving circularly polarized signals propagating along the elongated waveguide in the direction from the first port toward the second port thereof and translating the circularly polarized signals to linearly polarized signals traveling in one direction along the waveguide manifold.

2. A radio frequency multiplexer comprising:

(a) waveguide manifold means for transmitting wide band radio frequency signals;

(b) circular polarizing waveguide means for receiving at a first polarizer port a linearly polarized radio frequency signal to be combined and translating the linearly polarized signal to a circularly polarized signal as the signal energy travels there along toward a second polarizer port connected to the waveguide manifold means;

(c) coupling means associated with the waveguide manifold means for receiving the circularly polarized signal from the circular polarizing waveguide means and translating the circularly polarized signal to a linearly polarized signal traveling in one direction along the waveguide manifold means; and (d) radio frequency filter means connected to the first polarizer port of the circular polarizing waveguide means and to a radio frequency transmission line, the filter means for producing a unique filter characteristic in response to wide band radio frequency signals directed from the circular polarizing waveguide means.

3. The multiplexer of claim 2 wherein:

(a) the coupling means is also for translating an incident linearly polarized microwave frequency signal traveling in one direction along the waveguide manifold means to a circularly polarized signal traveling toward the first polarizer port of the circular polarizing waveguide means; and (b) the circular polarizing waveguide means is also for receiving the circularly polarized signal from the coupling means, and translating the circularly polarized signal thus received to a linearly polarized signal traveling along the circular polarizing waveguide means toward the first polarizer port.

4. The multiplexer of claim 2 wherein the waveguide manifold means includes:

(a) connecting means for connecting the waveguide manifold means to separate waveguide elements.

5. A radio frequency multiplexer of the type in which a plurality of channels are combined with or are separated from wide band signals traveling along a waveguide manifold, and including for each channel a coupling aperture arrangement associated with the waveguide manifold, each coupling aperture arrangement capable of translating a circularly polarized signal incident thereon to a linearly polarized signal traveling in one direction along the waveguide manifold, and translating a linearly polarized radio frequency signal traveling along the waveguide manifold to a circularly polarized signal, wherein the improvement comprises:

(a) circular polarizing means for each coupling aperture arrangement, each circular polarizing means being positioned to receive radio frequency signals traveling from a different one of the aperture arrangements and being adapted for translating circularly polarized radio frequency signals traveling from the respective coupling aperture arrangement with which it is associated to linearly polarized signals and for translating linearly polarized signals traveling toward the respective coupling aperture to circularly polarized signals as the signal energy travels there along; and (b) radio frequency filter means for each aperture arrangement, each radio frequency filter means being connected to a different one of the circular polarizing means for producing a desired frequency filtering characteristic in response to wide band radio frequency signals directed from said one of the circular polarizing means.

6. The multiplexer of claim 5 wherein the improvement further comprises:

(a) connector means associated with the waveguide manifold for connecting the waveguide manifold to separate waveguide elements.

7. The multiplexer of claim 5 wherein:

(a) each radio frequency filter means is connected directly to a different one of the circularly polarizing means; and (b) each circular polarizing means is connected directly to the waveguide manifold over a different one of the aperture arrangements.

8. A method of combining radio frequency channels, the method comprising the steps of:

(a) translating linearly polarized signals of a channel to be combined to circularly polarized signals with a circular polarizing waveguide;

(b) directing the circularly polarized signals to a coupling aperture arrangement of a waveguide manifold, the waveguide manifold being capable of carrying signals at the frequencies of the circularly polarized signals and also wide band signals;

(c) with the coupling aperture, translating the circularly polarized signals to linearly polarized signals traveling along the waveguide manifold in a single direction; and (d) filtering wide band signals traveling through the circular polarizing waveguide from the waveguide manifold with a linearly polarized radio frequency filter capable of blocking signals at frequencies outside of the channel to be combined.

9. The method of claim 8 wherein:

(a) the step of directing the circularly polarized signals to the coupling aperture arrangement is performed by the circular polarizing waveguide.

10. The method of claim 8 wherein:

(a) the step of filtering wide band signals is performed between the circular polarizing waveguide and a channel transmission line.

11. A method of separating a radio frequency channel from linearly polarized wide band signals traveling along a waveguide manifold, the method comprising the steps of:

(a) translating the linearly polarized wide band signals traveling along the waveguide manifold to circularly polarized wide band signals in a waveguide capable of supporting such circularly polarized signals;

(b) translating the circularly polarized wide band signals back to linearly polarized wide band signals with a circular polarizing waveguide; and (c) filtering the linearly polarized wide band signals translated by the circular polarizing waveguide with a linearly polarized radio frequency filter capable of passing only signals in a channel to be separated.

12. The method of claim 11 including the step of:

(a) directing the signals in the channel to be separated from the radio frequency filter through a single channel transmission means.

13. The method of claim 11 including the steps of:

(a) directing linearly polarized signals outside of the channel to be separated from the filter back to the circular polarizing waveguide;

(b) translating the linearly polarized signals outside of the channel to be separated to circularly polarized signals with the circular polarizing waveguide; and (c) translating the circularly polarized signals outside of the channel to be separated to linearly polarized signals traveling in the original direction of the wide band signals along the waveguide manifold.

14. The method of claim 11 wherein:

(a) the step of translating the linearly polarized wide band signals to circularly polarized wide band signals is performed by a coupling aperture arrangement in the waveguide manifold.

* * * * *